United States Patent [19]

Ims

[11] Patent Number: 4,881,769

[45] Date of Patent: Nov. 21, 1989

[54] HANDLING DEVICE FOR HYDRAULIC CYLINDER

[76] Inventor: Paul D. Ims, R.R. 1, Box 180, Echo, Minn. 56237

[21] Appl. No.: 210,315

[22] Filed: Jun. 23, 1988

[51] Int. Cl.[4] ..... B25G 7/12

[52] U.S. Cl. ..... 294/15; 294/67.1; 294/81.5; 294/119.2

[58] Field of Search ..... 294/15, 16, 27.1, 31.2, 294/67.1, 67.3–67.5, 81.5, 81.55, 81.56, 81.6, 119.2, 151, 153–155, 157, 170; 29/270, 271, 278, 281.1, 281.4, 281.5

[56] References Cited

U.S. PATENT DOCUMENTS

| | | | |
|---|---|---|---|
| 1,474,685 | 11/1923 | Parnell | 294/31.2 |
| 2,193,054 | 3/1940 | Bowen | 294/15 |
| 2,434,655 | 1/1948 | Homer | 294/15 X |
| 2,456,917 | 12/1948 | Cheek | 294/15 X |
| 2,655,300 | 10/1953 | Willms | 294/31.2 X |
| 3,093,257 | 6/1963 | Miller | 294/31.2 X |
| 3,790,050 | 2/1974 | Sullivan | 294/16 X |
| 4,565,397 | 1/1986 | Keen | 294/31.2 X |
| 4,575,142 | 3/1986 | Parker | 294/15 |

*Primary Examiner*—Johnny D. Cherry

[57] ABSTRACT

A device for carrying a hydraulic cylinder and for holding and adjusting such a cylinder and its piston to their attachment points while the device is being attached. The device is particularly useful in working with farm implements.

10 Claims, 3 Drawing Sheets

HANDLING DEVICE FOR HYDRAULIC CYLINDER

BACKGROUND AND SUMMARY OF THE INVENTION

This invention pertains to a tool useful in attaching a hydraulic cylinder and piston assembly in place on a farm implement and in attaching that assembly at both ends.

The use of hydraulic power, especially cylinder and piston assemblies using hydraulic pressure as a source of power is fairly common in farm implements and other earth-moving equipment. Usually referred to as hydraulic cylinders, the devices are very useful in raising the equipment above the ground for carrying and pressing the implement into the ground in order to work the ground.

As the basic machine—ordinarily a tractor—has gotten larger and larger, the need for larger cylinders has increased. In farm machinery, particularly, these cylinders are mounted or dismounted dependent on what particular type of implement is to be used on the tractor at any particular time. Thus, it is necessary on fairly frequent occasions to mount or demount the cylinder.

With larger equipment and thus heavier cylinders, the problems of carrying and holding the cylinder in place for mounting have increased. This is true both for the attachment of the cylinder itself to the tractor and also for the attachment of the operating rod of the piston to the implement. In fact, the problem is enlarged because of the need for adjustment of the piston within the cylinder so that the length of the assembly corresponds to the space between attachment points. The assembly is not in place until both ends are fastened, and frequently, the second end is more difficult to fasten than the first because the piston must be extended to the proper position longitudinally as well as being adjusted laterally which means vertically in many instances.

By my invention I provide a handle that is readily attached or detached, which will make handling the cylinder much easier and which, includes adjustable means adapted to gauge and to hold the cylinder as the piston is moved to the correct longitudinal position for attachment of that end. I also provide a gauge means for determining the proper position of the piston end for the insertion of a fastening pin.

FIGURES

Figure 1:
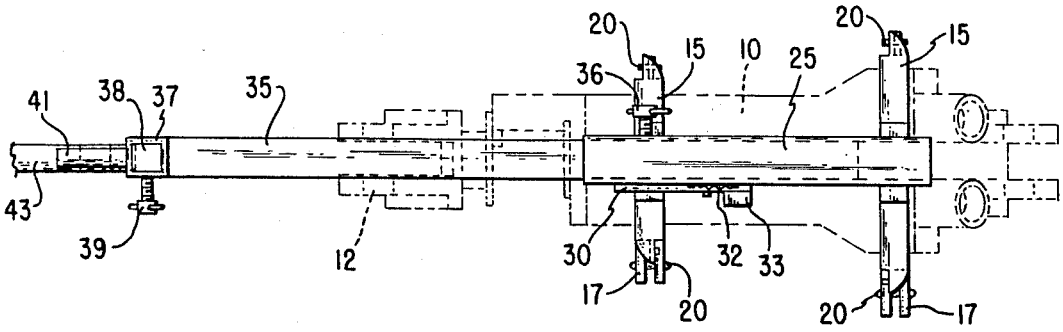
Figure 2:
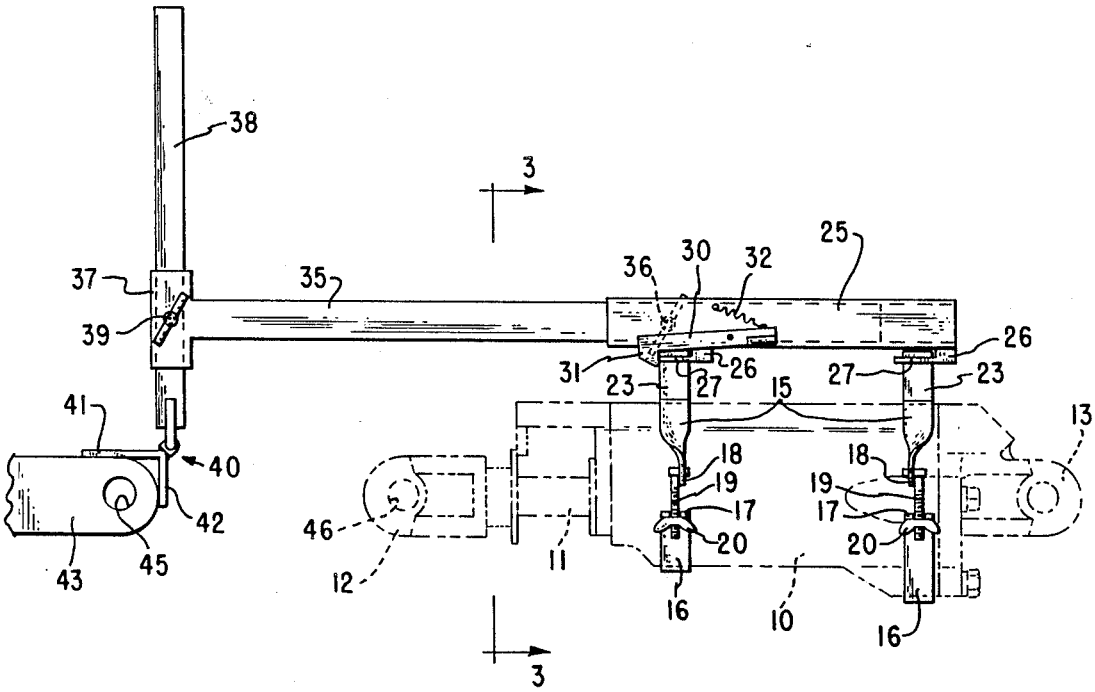
Figure 5:
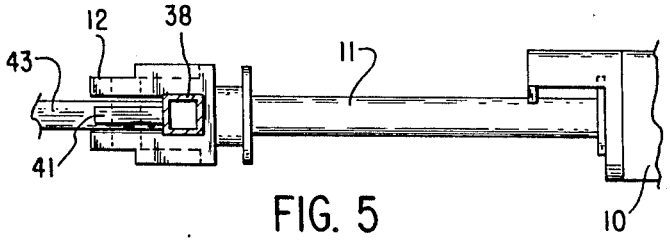
Figure 6:
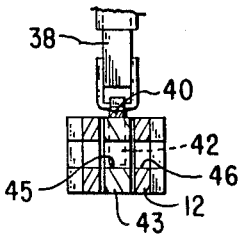
Figure 4:
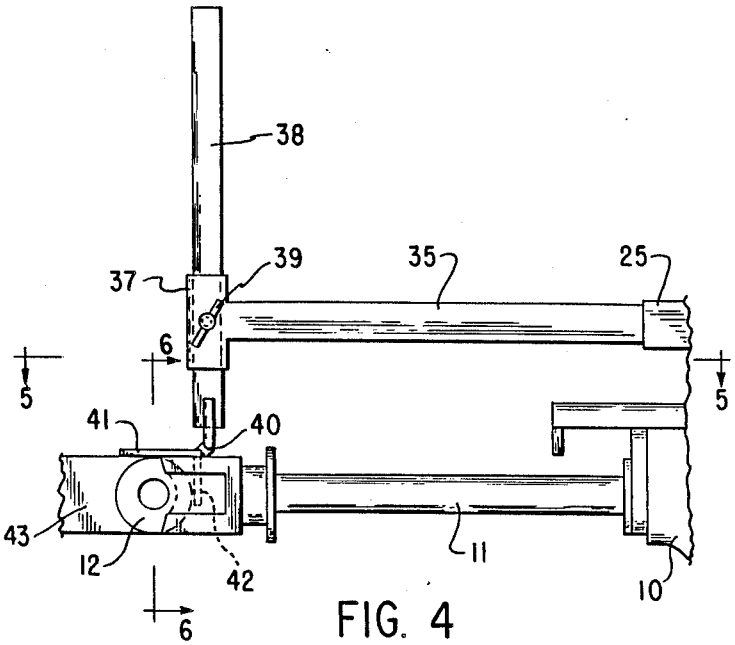
Figure 7:
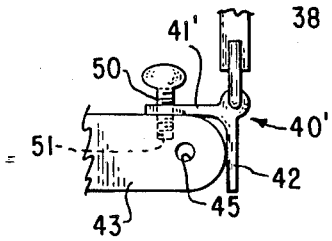
Figure 3:
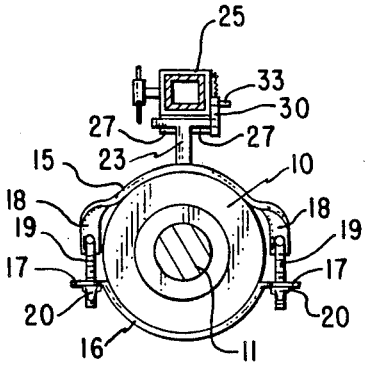
Figure 8:
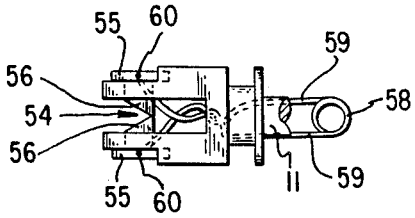
Figure 10:
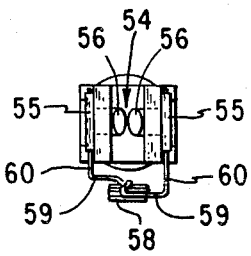
Figure 9:
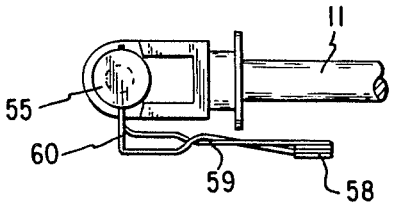
Figure 11:
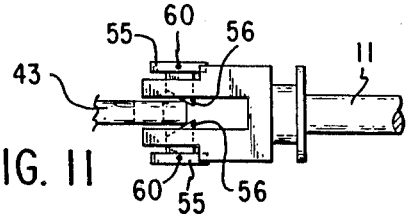
Figure 12:
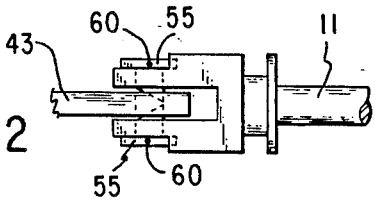

FIG. 1 is a top plan view of a hydraulic cylinder with the device of my invention in place thereon, FIG. 2 is a side elevational view of the assembly shown in FIG. 1, FIG. 3 is a view from line 3—3 of FIG. 2, FIG. 4 is a side elevational view of the connecting end of the piston rod and of the adjustment gauge used in connection therewith, FIG. 5 is a view from line 5—5 of FIG. 4, FIG. 6 is a view from line 6—6 of FIG. 5, FIG. 7 is a detailed view of an alternate gauge device, FIG. 8 is a top plan view of the connecting end of the piston rod with a novel gauge means in place, FIG. 9 is a side elevational view of the part of my device shown in FIG. 7, FIG. 10 is an end elevational view of the device shown in FIG. 8, FIG. 11 is a view similar to FIG. 7 showing the connecting end being moved onto the part to which it is to be connected, and FIG. 12 is a view similar to FIG. 10 in which the gauge has determined the proper position.

DESCRIPTION

Briefly my invention comprises an attachment to be used with a hydraulic cylinder to provide a carrying and holding handle and further to adjustably gauge the proper extension of the piston for attachment of the piston end.

More specifically, and referring to the drawings, I show a hydraulic cylinder assembly including a cylinder 10 in which is disposed a piston including a piston rod 11. Fixed on the end of the rod 11 is an attachment clevis 12 normally attachable to an implement. The cylinder also has an attachment eye 13 at the end opposite the rod 11 for attachment of the cylinder 10 to the tractor or other motive power.

Because, particularly in the larger sizes currently in use with farm machinery, these devices are fairly heavy, it becomes clumsy to handle the cylinders. Therefore, my device comprises essentially a removable handle. As illustrated, I provide partial loops 15 which are completed by clamping straps 16. The straps 16 are formed with flanges 17, and the loops 15 have ears 18. Adjustable hook means 19 are adapted to be engaged between the flanges 17 and the ears 18. As illustrated, the hook ends are engaged in openings in the ears 18 and have threaded ends extending through open slots in the flanges 17. Wing nuts 20 threaded onto the threaded ends provide adjustment. This arrangement works well and is my preferred embodiment. However, it will be apparent that there are other clamping arrangements that may be used.

At the upper portion of the loops 15, I provide a T-shaped attachment 23. My handle device is adapted to releasably engage these T-shaped portions.

The handle device comprises a handle 25, which I prefer to form from a piece of square tubing. Depending from the underside of the handle 25 are a pair of forked members 26 having tines 27 adapted to slip under the cross member of the T-shape attachment 23 and to straddle the vertical part of the attachment. Thus, the handle, in the attached position, as shown is in position whereby the cylinder can be readily lifted by lifting on the handle 25.

In order to prevent inadvertent withdrawal and release of the tines 27 from the T-shaped connectors, I provide a latch on the handle. This latch comprises a lever member 30 (FIGS. 1 and 2) pivotally connected to the handle 25. The member 30 is formed with a hook shaped end 31 adapted to hook over the cross member of the connector 23 so as to hold the connector engaged with the tines 27. A spring 32 engaged between the handle 25 and the lever 30 serves to bias the lever to the engaged position as shown. To release the latch, the user could press down on a flange 33 formed on the lever against the pressure of the spring 32. When the hook 31 is disengaged, the handle can readily be slid to release the tines 27 from the connectors 23, and the handle removed.

Carrying the cylinder is one part of the problem of handling such a device. By using my handle, it becomes easy to carry the cylinder and lift it into position. Thus, the cylinder can be positioned so that the eye 13 can be pinned in place and that end of the cylinder properly mounted. However, connecting the piston rod through its clevis 12 requires not only positioning the cylinder but also extending the rod 11 to the proper length.

By my invention, I also provide for that positioning. In order to locate the correct position, I use a telescoping beam 35 which slides into ("telescopes" into) the handle 25. In order to hold the arm in any chosen adjusted position, I provide a set screw 36 threaded into the handle 25 and adjusted to press on the beam 35.

At its outer end, the beam 35 carries a vertically arranged collar 37. A vertical support or post 38 is slidably journalled in the collar 37 and may be held in adjusted position by a set screw 39 similar to the screw 36 on the handle 25. At the bottom of the post and pivotally connected to it, I provide a gauge piece 40. This piece is in the form of a right angled member having a longer upper leg 41 and a shorter leg 42. These legs are adapted to gauge the position of the clevis 12 with relation to the tongue 43 on the mechanism or implement to be operated by the hydraulic device as described hereafter.

In use, the vertical post 38 is first adjusted. The object is to adjust this post so that when the longer leg 41 of the gauge 40 is horizontal, it will lie on the top of the tongue 43 and hold the cylinder in position such that the hole 45 in the tongue will register with the holes 46 (see FIG. 2) of the clevis 12. Once the position is established, the post 38 can be marked for each cylinder and each implement.

After the post 38 is properly set, the cylinder which is already attached at the attachment eye 13 can be tilted around that point by using the handle 25. The beam 35 can then be extended to a position where the longer leg 41 of the gauge rests on the tongue 43 and the shorter leg 42 abuts the edge of that tongue as shown in FIG. 2. When the beam 35 is properly adjusted, the entire device can rest in that position and operation of the hydraulic mechanism can extend the rod 11 until the holes 46 register with the hole 45. Then a pin (not shown) can be inserted and the device is assembled. Notably absent is the opportunity to crush fingers by trying to raise or lower the cylinder by use of the rod 11 or the clevis 12.

In some instances, where the end of the tongue 43 is formed by a long radius curve, the use of the simple long leg 41 is not fully adequate to hold the device in position. In FIG. 7 I illustrate an alternative gauge member 40' which will be useful in such instances. This member includes a threaded pin 50 threadably engaged with and extending through the alternative longer leg 41'. A hole 51 drilled into the tongue is adapted to receive the end of the pin 50. The engagement between the pin 50 and the edges of the hole 51 will serve to hold the gauge member properly in place.

In order to ascertain that the holes in the tongue 43 and clevis 12 do register properly, I provide an auxiliary device adapted to be used with the gauging mechanism. This device acts as an alignment means and includes a pair of headed pegs, each having a head 55 and a peg 56. The pegs 56 are adpated to fit fairly closely in the holes 46 in the clevis 12. The fit should be such that they are easily slidable, but not loose. The ends of the pegs opposite to the heads 55 are beveled so that when the two pegs are in place in the clevis as shown in FIG. 8, the beveled ends form a V-shaped notch 54.

To hold the pegs in place on the clevis 12, I provide a wire spring device including a coil spring 58 with arms 59 extending to fingers 60. The fingers extend into holes formed in the heads 55, and the spring is biased so that the pegs 56 are urged toward each other.

When the device is used, the cylinder is located by the rest of my mechanism, as described before. As the rod 11 is extended carrying the clevis 12 toward the tongue 43, the pegs are in an abutting position as shown in FIG. 8. When the clevis is crried further, the clevis 12 carries the pegs until the tongue 43 enters the V-shaped notch and contacts the beveled ends of the pegs 56. Further movement will cause the pegs to be slid apart like a cam as shown in FIG. 11. Eventually, as the clevis continues to move, and if the holes are properly aligned, the pegs 56 will enter the hole 45 in the tongue 43. At that point, the movement of the rod 11 and clevis 12 should be stopped. The pegs 56 can then be withdrawn and a permanent pin inserted to allow operation of the hydraulic mechanism.

Thus, I have provided a system and means to allow easy placement of a hydraulic cylinder assembly without damage to hands or fingers.

I claim:

1. For use with a hydraulic piston-cylinder assembly having an attachment eye on said cylinder and a clevis attached to said piston, said clevis being attachable to a means to be operated by said assembly, carrying and adjustment means comprising strap means adapted to be attached to said cylinder, said strap means including T-shaped attachment means, handle means including forked members slideably engageable with said T-shaped attachment means or said strap means, said handle means when engaged being spaced from said cylinder whereby hand carrying is possible.

2. The carrying and adjustment means of claim 1 in which latch means on said handle means is engageable with said attachment means to hold said forked members releasably in engagement with said attachment means.

3. For use with a hydraulic piston-cylinder assembly having at attachment eye on said cylinder and a clevis attached to said piston, said clevis being attachable to a means to be operated by said assembly, carrying and adjustment means comprising strap means adapted to be attached to said cylinder, handle means releasably engageable with said strap means, said handle means when engaged being spaced from said cylinder whereby hand carrying is possible, locating means adjustably attached to said handle means, said locating means including a beam adjustable longitudinally of said cylinder, and post means adjustable transversely of said cylinder, said locating means being adjustable to locate the attachment point for said clevis.

4. The carrying and adjustment means of claim 3 in which said post means includes a gauge piece, said gauge piece being adapted to hold the cylinder-piston assembly in position to allow said clevis to be engaged with the means to be operated.

5. The carrying and adjustment means of claim 4 in which said locating means comprises a beam in telescoping, slidable engagement with said handle means; means engageable between said beam and said handle means to hold said beam in an adjusted position; a collar on said beam; said post means being slidably adjustable in said collar, and holding means engageable between said collar and said post means to hold said post means in an adjusted position.

6. The carrying and adjustment means of claim 4 in which said clevis is adapted to be attached to an attachment tongue, and in which said gauge piece comprises a right-angled member pivotally attached to said post means, said right-angled member having one longer leg and one shorter leg, said longer leg being adapted to rest on the top surface of said tongue and said shorter leg adapted to abut an end of said tongue.

7. The carrying and adjustment means of claim 6 in which a pin is mounted on said longer leg, said pin being engageable with said tongue to hold said right-angled member in place on said tongue.

8. For use with a hydraulic cylinder and piston assembly attachable between a fixed base and a movable implement, said piston having a rod with an attachment end including a clevis means and said implement having a tongue adapted to engage said clevis means; in combination, carrying and adjustment means comprising handle means releasably attached to said cylinder, locating means adjustably mounted on siad handle means and adapted to locate the tongue on said implement to which said attachment end is to be fastened, and alignment means removably connected with said clevis on the attachment end of said rod and adapted to gauge proper alignment of said attachment end of said rod with said tongue on said implement.

9. The combination of claim 8 in which the tongue on said implement and the clevis of said rod are both formed to provide holes of similar size through which a pin can be inserted, said alignment means comprising a pair of aligned pegs slidably disposed in and extending through the holes in the clevis, and spring means attached to said pegs to bias said pegs toward each other.

10. The combination of claim 9 in which the adjacent ends of said pegs are formed to provide a V-shaped notch, said notch being engageable by said tongue to move said pegs apart against the bias of said spring means.

* * * * *